US008640594B2

(12) United States Patent
Treadway et al.

(10) Patent No.: US 8,640,594 B2
(45) Date of Patent: Feb. 4, 2014

(54) BLAST DEFLECTING SHIELD FOR GROUND VEHICLES AND SHIELDED GROUND VEHICLES AND METHODS INCLUDING SAME

(75) Inventors: Sean Kevin Treadway, Mooresville, NC (US); Michael Robert Eidell, Huntersville, NC (US)

(73) Assignee: Corvid Technologies, Inc., Mooresville, NC (US)

( * ) Notice: Subject to any disclaimer, the term of this patent is extended or adjusted under 35 U.S.C. 154(b) by 0 days.

(21) Appl. No.: 13/361,546

(22) Filed: Jan. 30, 2012

(65) Prior Publication Data

US 2012/0247315 A1 Oct. 4, 2012

Related U.S. Application Data

(60) Provisional application No. 61/438,397, filed on Feb. 1, 2011.

(51) Int. Cl.
*F41H 7/00* (2006.01)
*F41H 5/02* (2006.01)

(52) U.S. Cl.
USPC ... 89/36.08; 89/929; 296/187.07; 296/187.08

(58) Field of Classification Search
USPC ..... 89/36.08; 296/187.07, 187.08
See application file for complete search history.

(56) References Cited

U.S. PATENT DOCUMENTS

| | | | | |
|---|---|---|---|---|
| 7,357,062 | B2 | 4/2008 | Joynt | |
| 7,540,229 | B2 * | 6/2009 | Seo et al. | 89/36.17 |
| 8,376,452 | B2 * | 2/2013 | Klasfauseweh et al. | 296/187.07 |
| 8,418,594 | B1 * | 4/2013 | Dunne et al. | 89/36.02 |
| 2007/0186762 | A1 | 8/2007 | Dehart et al. | |
| 2009/0140545 | A1 * | 6/2009 | Greuter et al. | 296/187.07 |
| 2009/0272254 | A1 * | 11/2009 | Hunn et al. | 89/36.02 |
| 2010/0218667 | A1 * | 9/2010 | Naroditsky et al. | 89/36.02 |
| 2012/0174767 | A1 * | 7/2012 | Naroditsky et al. | 89/36.08 |
| 2012/0186428 | A1 * | 7/2012 | Peer et al. | 89/36.02 |
| 2012/0192708 | A1 * | 8/2012 | Kocher et al. | 89/36.08 |

OTHER PUBLICATIONS

Catenary. (n.d.). In *Wikipedia*. Retrieved Jan. 25, 2011, from http://en.wikipedia.org/wiki/Catenary.

* cited by examiner

*Primary Examiner* — Bret Hayes
*Assistant Examiner* — Derrick Morgan
(74) *Attorney, Agent, or Firm* — Myers Bigel Sibley & Sajovec, PA

(57) ABSTRACT

A blast shield for deflecting a blast incident on a ground vehicle includes an impact section having an exterior impact surface to face a source of the blast. The exterior impact surface defines a cross-sectional profile defining a smooth continuous curve.

15 Claims, 5 Drawing Sheets

BLAST DEFLECTING SHIELD FOR GROUND VEHICLES AND SHIELDED GROUND VEHICLES AND METHODS INCLUDING SAME

RELATED APPLICATION(S)

The present application claims the benefit of and priority from U.S. Provisional Patent Application No. 61/438,397, filed Feb. 1, 2011, the disclosure of which is incorporated herein by reference in its entirety.

STATEMENT OF GOVERNMENT SUPPORT

This invention was made with support under Small Business Innovation Research (SBIR) Contract No. W911QX-10-0022 awarded by the United States Army. The Government has certain rights in the invention.

FIELD OF THE INVENTION

The present invention relates to blast protection and, more particularly, to the protection of ground vehicles from shock waves and projectiles created by threat explosions, for example.

BACKGROUND OF THE INVENTION

Threat explosions may come from mines and other explosive devices, improvised or otherwise, placed in or near the path of a vehicle. Mine or explosive device placement may be buried, on the ground surface, or just about the ground level. Further, these mines or explosive devices may be encountered directly under the center of the vehicle or offset laterally from the vehicle path.

Traditionally, ground vehicles have been shielded from explosions using heavy armor plates. These plates may have adequate strength and mass to prevent breach from explosive overpressures and penetration by projectiles. The United States military's M2 Bradley Infantry Fight Vehicle (a tracked vehicle weighing approximately 30 tons) is an exemplary vehicle that employs this approach.

Tactics in recent conflicts have required sending vehicles with significantly less armor and weight onto the battlefield. Also, recent conflicts have seen the advent of land mines and other explosive devices with much greater explosive power. These factors have driven the design of armored personnel carriers and assault vehicles that can withstand substantial explosive loading.

The new classes of armored vehicle are of lighter weight and higher maneuverability than traditional configurations, and are typically based on a wheeled design as opposed to tracks. Examples of these new vehicles include the U.S. military's various Mine Resistant Ambush Protected (MRAP) models and the Stryker armored fighting vehicle. The design of these vehicles relies not only on the strength of armor materials in the structure, but also the geometry of the outer body to deflect blasts from explosive threats.

Using blast deflecting geometries enables new vehicle designs to attain higher levels of protection for a given armor mass. The result is lighter and more maneuverable fighting vehicles and personnel carriers that provide required protection to occupants and retain operational function when attacked from underneath or laterally with explosive devices.

To date, a downward pointing "V"-shaped geometry is the primary vehicle hull design used to enhance blast protection. This stands in comparison to the flat underneath of the more traditional M2 Bradley. The V-Hull design is intended to deflect away upwardly propagating blast, projectiles, and debris produced by buried mines and explosives devices at or near ground level. An exemplary V-hull design is disclosed in U.S. Published Patent Application No. 2007/0186762 A1.

SUMMARY OF THE INVENTION

According to some embodiments of the present invention, a blast shield for deflecting a blast incident on a ground vehicle includes an impact section having an exterior impact surface to face a source of the blast. The exterior impact surface defines a cross-sectional profile defining a smooth continuous curve.

According to some embodiments, the profile defines a non-uniform smooth continuous curve. In some embodiments, the profile substantially defines a catenary. More particularly, in some embodiments, the profile defines a catenary having a curvature coefficient a in the range of from 3 to 30.

According to some embodiments, the impact section is monolithic.

The impact section may be formed of metal.

In some embodiments, the impact section is formed of fiber-reinforced composite.

According to some embodiments, the blast shield includes at least one vehicle attachment structure integral with the impact section and configured to secure the blast shield to the ground vehicle.

In some embodiments, the blast shield includes a reinforcing rib extending across the impact section on an interior side thereof opposite the impact surface.

According to embodiments of the present invention, a shielded ground vehicle includes a ground vehicle and a blast shield for deflecting a blast incident on the ground vehicle. The blast shield is integrated with the ground vehicle. The blast shield includes an impact section having an exterior impact surface to face a source of the blast. The exterior impact surface defines a cross-sectional profile defining a smooth continuous curve.

According to some embodiments, the profile defines a non-uniform smooth continuous curve. In some embodiments, the profile substantially defines a catenary. In some embodiments, the profile defines a catenary having a curvature coefficient in the range of from 3 to 30.

According to some embodiments, the impact section is monolithic.

In some embodiments, the impact section is formed of metal.

The impact section may be formed of fiber-reinforced composite.

In some embodiments, the blast shield includes at least one vehicle attachment structure integral with the impact section and securing the blast shield to the ground vehicle.

According to some embodiments, the blast shield includes a reinforcing rib extending across the impact section on an interior side thereof opposite the impact surface.

According to method embodiments of the present invention, a method for operating a shielded ground vehicle includes providing a shielded ground vehicle including: a ground vehicle; and a blast shield for deflecting a blast incident on the ground vehicle. The blast shield is integrated with the ground vehicle and includes an impact section having an exterior impact surface to face a source of the blast. The exterior impact surface defines a cross-sectional profile defining a smooth continuous curve. The method further includes receiving a blast on the exterior impact surface.

According to some embodiments, the profile defines a catenary.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF EMBODIMENTS OF THE INVENTION

Figure 1:
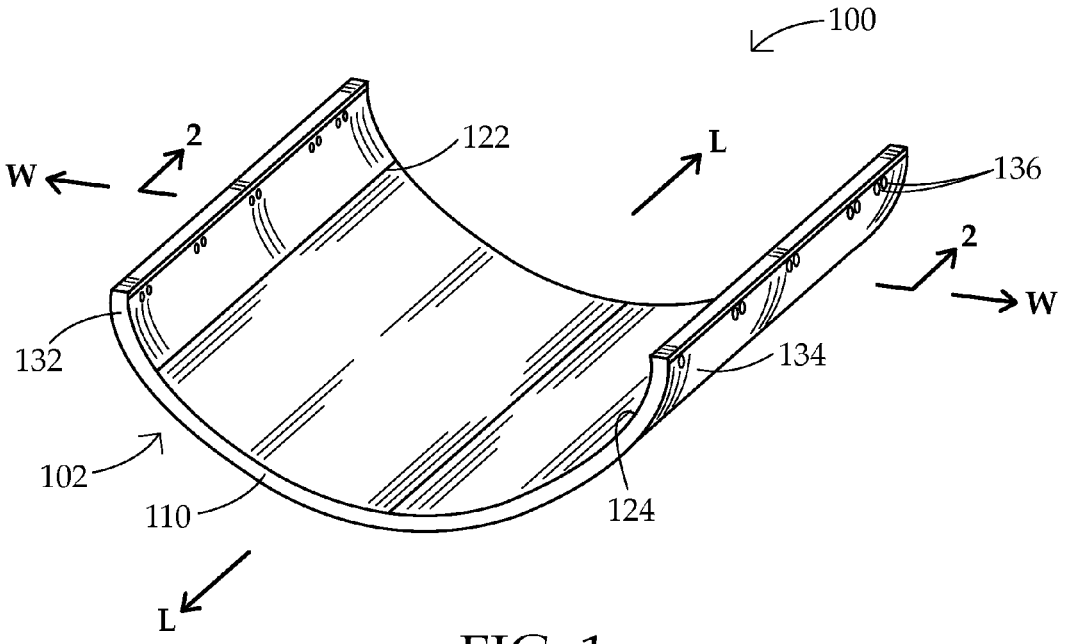
FIG. 1 is a top perspective view of a blast shield according to embodiments of the present invention.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As used herein, "monolithic" means an object that is a single, unitary piece formed or composed of a material without joints or seams.

Embodiments of the present invention provide an underbody shield for ground vehicles (such as armored ground vehicles) that has a generally curved profile. This curved shield can act as a blast shield by deflecting away energy, projectiles, and/or debris from an explosive blast, while at the same time minimizing energy absorbed by the vehicle from the blast. The shield's geometry can be well defined mathematically. Construction is possible from a range of existing materials typically used in vehicle armor applications. The shield may be integral with the vehicle crew structure or added as a covering to the vehicle underbody frame.

With reference to FIGS. 1-4, a curved hull, shell or blast deflecting shield (blast shield) 100 according to embodiments of the present invention is shown therein. The shield 100 includes a curved shell 102 and protruding, integral vehicle attachment structures or flanges 132, 134 that are appropriate for interface with a given vehicle design. However, other mechanisms or features may be employed for securing the blast shield 100 to a vehicle. Bolt holes 136 (FIG. 1) may be formed in the flanges 132, 134.

According to some embodiments, the shield 100 has the shape of an elongate channel as shown. However, other configurations may be provided.

Figure 7:
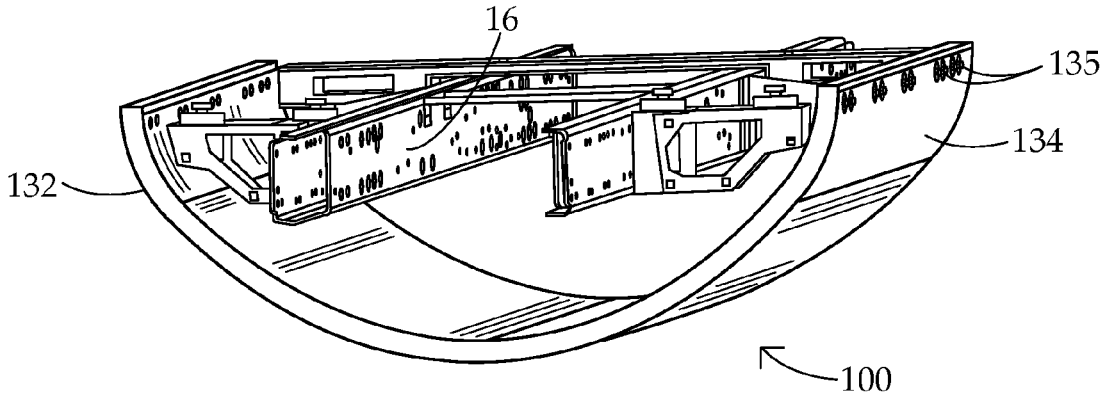
FIG. 7 is a perspective view of the blast shield of FIG. 1 mounted on an underbody vehicle frame.

The blast shield 100 may be mounted on or integrated into a suitable vehicle, such as an armored vehicle, in any suitable manner. In FIGS. 5-8, the curved blast shield 100 is shown integrated with an armored vehicle 10 to form, collectively, a shielded armored vehicle 15. The shield 100 may be integral to an occupant cabin 17 of the vehicle 10 as show in FIGS. 5-6. In some embodiments, for example as shown in FIG. 7, the blast shield 100 may be mounted on a vehicle underbody frame 16 of the vehicle 10. The shield 100 may be directly or indirectly secured to the cabin 17, frame 16 or other vehicle component(s) (e.g., by welding or using fasteners such as bolts 135).

Figure 5:
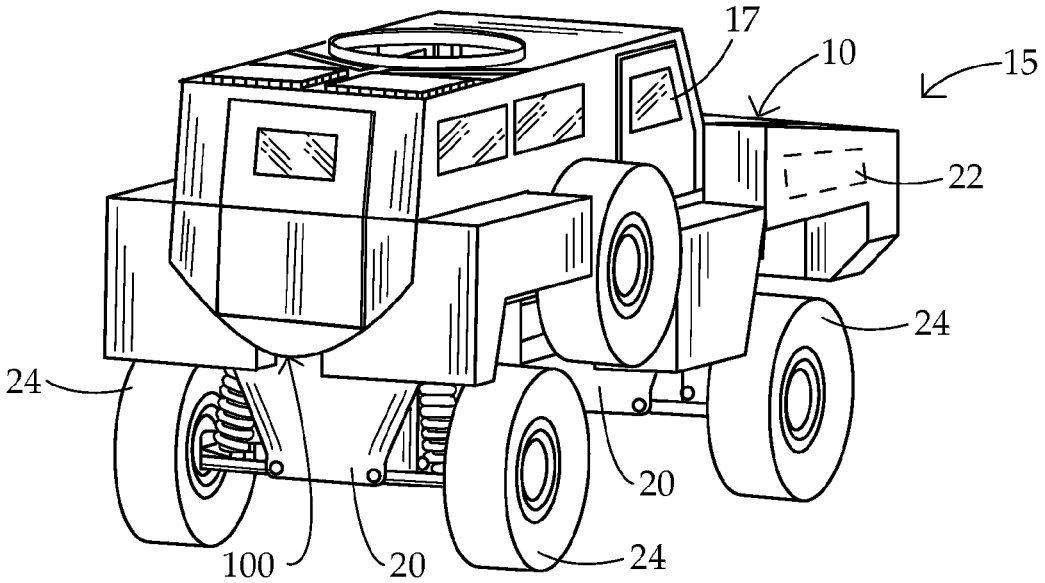
FIG. 5 is a top, rear perspective view of a shielded armored vehicle including the blast shield of FIG. 1 in accordance with embodiments of the present invention.
Figure 6:
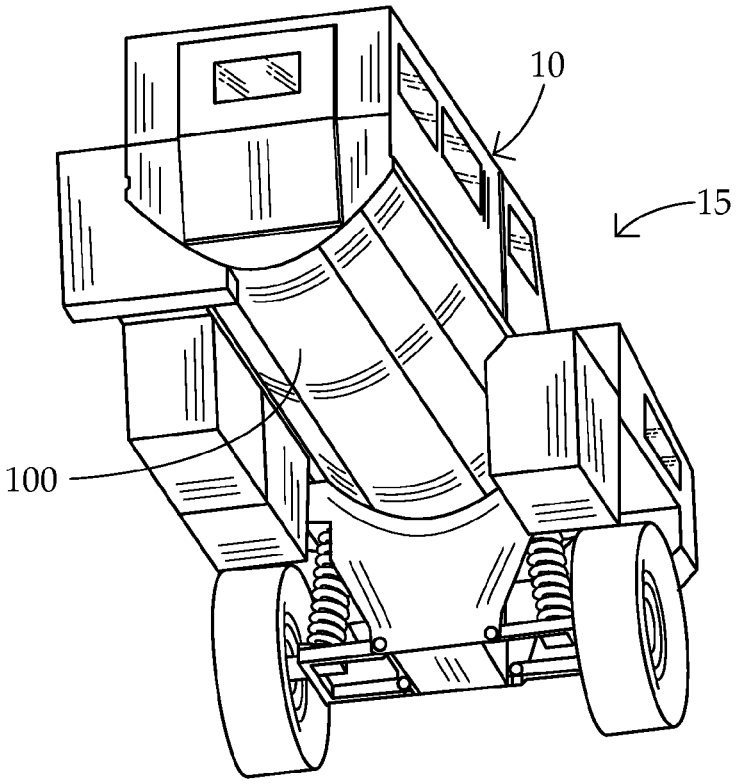
FIG. 6 is a bottom, rear perspective view of the shielded armored vehicle of FIG. 5.

The vehicle 10 may be a vehicle of any suitable type and construction. According to some embodiments and as shown in FIG. 5, the vehicle 10 is an armored vehicle including a chassis 20 (which may include an underbody vehicle frame 16), a drive unit 22 (e.g., an internal combustion engine), a transmission, force a transfer or conveying units (e.g., wheels 24 (as shown) or tracks; the rear wheels 24 are omitted in FIG. 6 for the purpose of explanation), and a vessel or cabin 17 (for housing personnel, supplies and/or equipment). According to some embodiments, the vehicle is an armored military vehicle. Exemplary vehicles include the MRAP and the Stryker armored fighting vehicle.

According to some embodiments, the shield 100 is retrofitted (e.g., by welding or fasteners) onto an existing vehicle and may replace a blast shield of other design (e.g., a V-hull). According to other embodiments, the shield 100 is mounted on or integrated into the vehicle during original manufacture of the vehicle.

Figure 8:
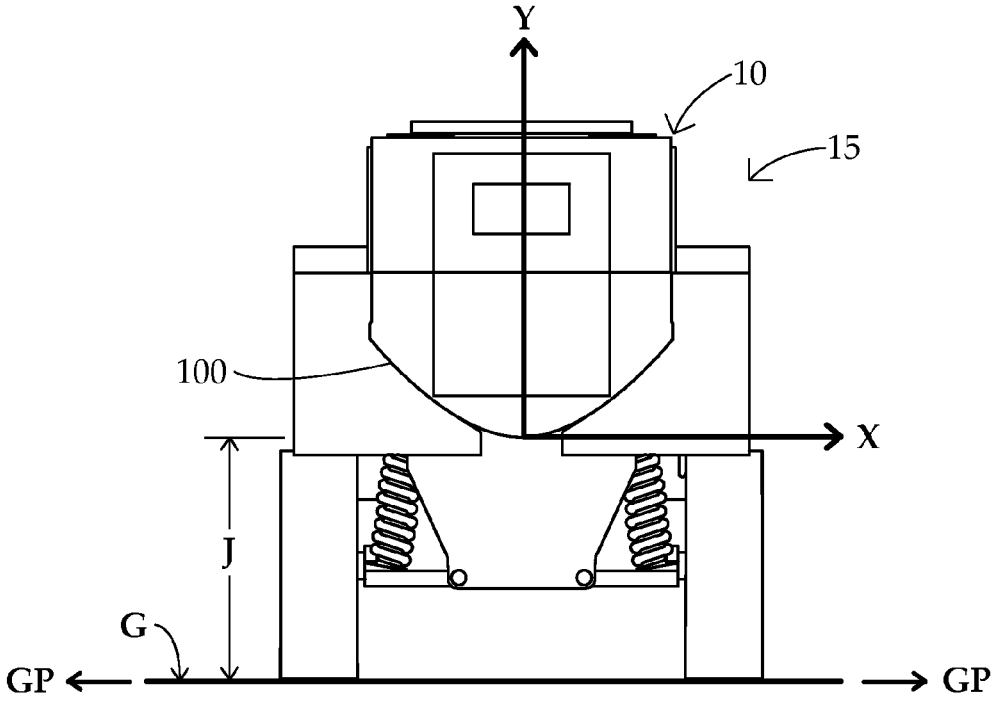
FIG. 8 is a rear view of the shielded armored vehicle of FIG. 5.

FIG. 8 shows the relationship of the blast shield 100 curve geometry to the vehicle 10 in general and to a ground plane GP-GP defined by the adjacent underlying ground G, in accordance with some embodiments of the present invention.

The blast shield 100 is oriented convexly relative to the ground plane GP-GP (i.e., the convex outer surface of the shield 100 faces the ground plane GP-GP). Explosive threats to be addressed by the shield 100 are assumed to be located under, just above, or co-located with the ground plane GP-GP. Further, explosive threats may be encountered directly under the center of the vehicle, or offset laterally from the vehicle path.

The shield 100 has a longitudinal axis L-L extending generally parallel to the lengthwise axis (i.e., the fore-aft axis) of the vehicle 10, a heightwise axis H-H extending perpendicular to the longitudinal axis L-L and the ground plane GP-GP (and typically generally parallel to vertical), and a transverse or lateral axis W-W extending perpendicular to each of the axes L-L and H-H (and generally parallel to the ground plane GP-GP).

The shield 100 includes an effective or main section 110 extending from a first lengthwise extending side edge 122 (adjoining the flange 132) to a second, opposed lengthwise extending side edge 124 (adjoining the flange 134). The main section 110 has an exterior or impact surface 112 that faces outwardly from the vehicle 10 and generally downwardly toward the ground G. An opposed interior surface 114 of the main section 110 faces away from the ground G. In service, the impact surface 112 serves as the impact surface to receive (and deflect and/or absorb) a blast.

According to some embodiments, the shield 100 takes the form of a bent plate or panel having substantially uniform thickness T (between the surfaces 112 and 114) over substantially all or a majority of its width. According to some embodiments, at least the main section 110 is monolithic and, in some embodiments, the shield 100 is monolithic.

Figure 2:
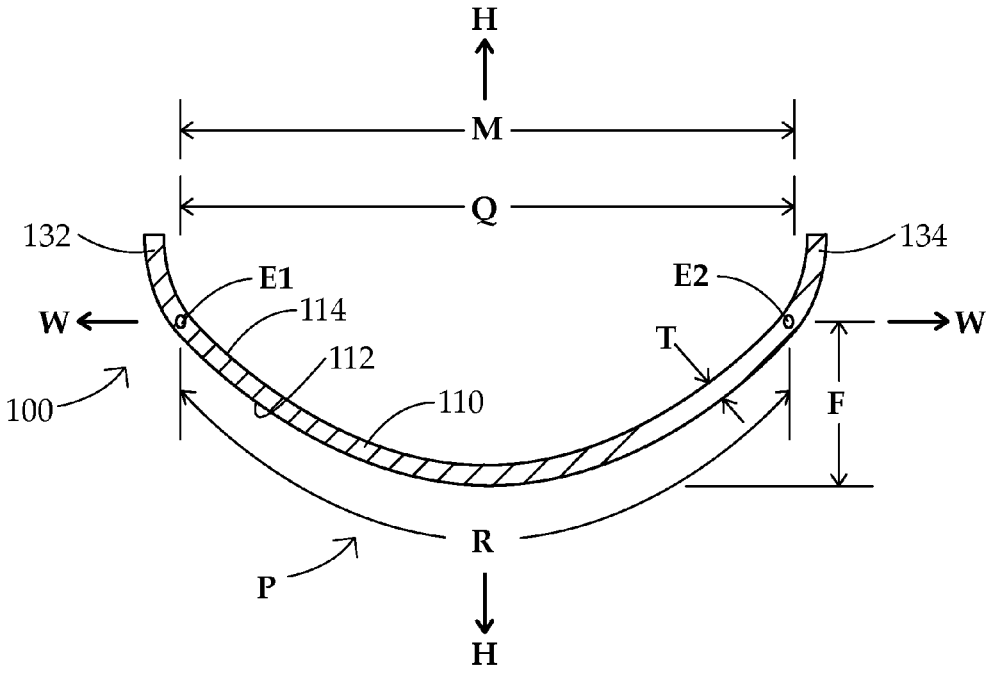
FIG. 2 is a cross-sectional view of the blast shield of FIG. 1 taken along the line 2-2 of FIG. 1.
Figure 3:
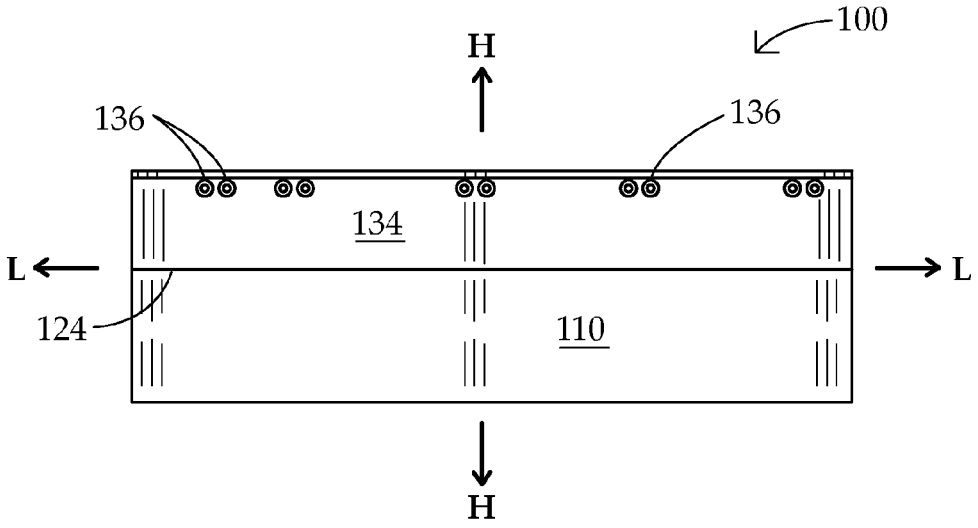
FIG. 3 is a side view of the blast shield of FIG. 1.
Figure 4:
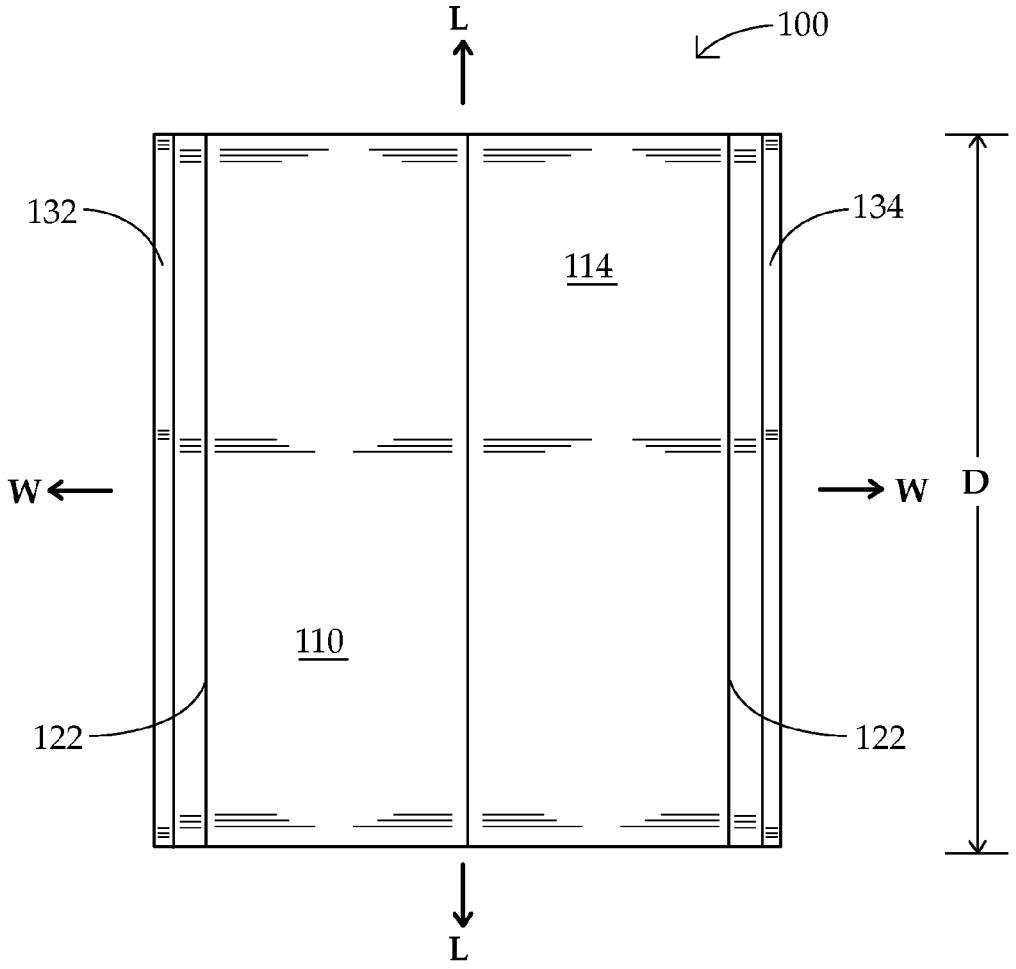
FIG. 4 is a top view of the blast shield of FIG. 1.

As shown in FIG. 2 (which is a cross-sectional view taken along the line 2-2 of FIG. 1), the impact surface 112 defines in lateral cross-section (i.e., a cross-section taken along a line parallel to the lateral axis W-W) an arcuate or curved profile P. The profile P has a linear length or distance Q and an arc length R each extending from a first terminal end point E1 (as shown, at the flange 132) to a second terminal end point E2 (as shown, at the flange 134).

According to some embodiments, the profile P is convex with respect to the ground. According to some embodiments, the profile P is convex with respect to the ground over the full length Q and arc length R of the profile P. According to some embodiments, the profile P is substantially symmetric about the axis H-H.

According to some embodiments, the curvature of the profile P defines a smooth continuous curve over the entirety of the length Q and arc length R so that the impact surface 112 does not define any hard angles or sharp corners. According to some embodiments, the profile P is a $C^1$ continuous curve over the entirety of the length Q and arc length R. According to some embodiments, the profile P is a non-uniform curve. According to some embodiments, the profile P is a catenary over the substantial entirety of the length Q and arc length R.

According to some embodiments, the curvature of the profile P of the curved blast shield 100 is generally described by Equation 1 as follows (with reference to FIG. 8):

$$y = \frac{a}{2}\left(e^{\frac{x}{a}} + e^{-\frac{x}{a}}\right) \qquad \text{Equation 1}$$

Curvature Equation Parameters:

x is the coordinate on the profile P along the vehicle lateral axis X;

y is the coordinate on the profile P along the vehicle vertical axis Y;

a is the curvature coefficient that defines the curve aspect ratio; and e is the base of the natural logarithm function, approximated by 2.7182818 . . . .

Figure 9:
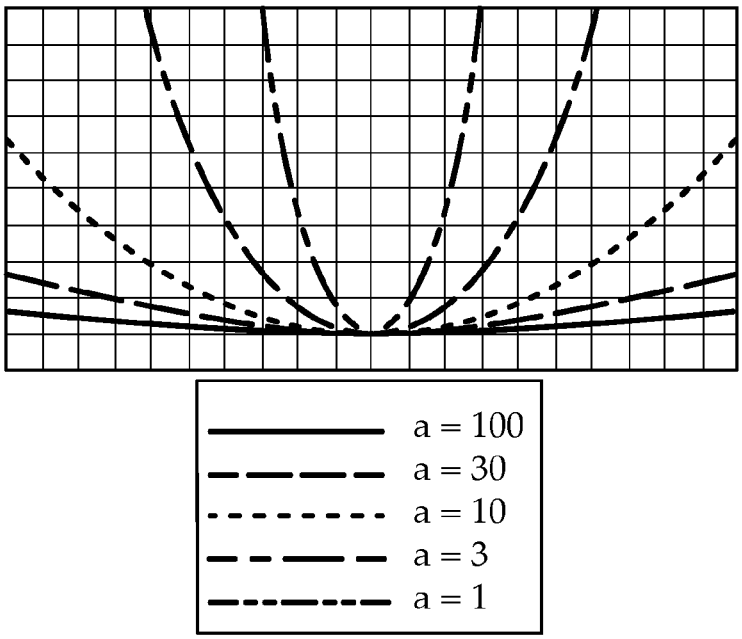
FIG. 9 is a graph illustrating blast shield curvature profiles for different selected curvature coefficient values.

Equation 1 is based on variational principles. FIG. 9 illustrates a range of blast shield 100 curvatures that can be generated by a range of a values in Equation 1. Blast shield geometry based on Equation 1 can minimize the surface area that is near to the ground plane, and provides sides that taper away from the ground plane GP-GP in a continuous fashion, and have a smooth transition across the line of symmetry (i.e., the Y-axis). According to some embodiments, the curvature of the profile P has a curvature coefficient a in the range of from 100 to 0.1, according to some embodiments, in the range of from 3 to 30 and, according to more particular embodiments, in the range of from 5 to 15.

According to some embodiments, and as illustrated in the figures, the length Q and the arc length R of the profile P extend widthwise across the entirety of the exposed impact surface 112 (i.e., fully across the main section 110) so that the profile P is defined by the full width M of the main section 110. However, it is contemplated that only a portion of the main section 110 may define a profile P having the characteristics described above (e.g., a smooth continuous curve or catenary). According to some embodiments, the profile P is defined by at least a majority of the width M of the main section 110, according to some embodiments, at least 80% of the width M of the main section 110, and according to some embodiments, at least 90% of the width M of the main section 110.

The shield 100 may be constructed from any suitable materials. In some embodiments, the shield 100 is formed of a metal (which may include steel or aluminum) or fiber-reinforced composite. Suitable steels may include 4130 and 4340 alloys, which may or may not be heat treated after forming. Suitable aluminums may include 5083-H131, 7039, 2139-T8, 2195-BT, 5059-H131, and/or 7075-T651. Fiber-reinforced composites may include glass fibers, carbon fibers, aramid fibers, and/or ultra-high-weight polyethylene, in combination with resins including epoxy, phenolic, urethane, and/or urea, to form a fiber-reinforced composite.

Shields according to embodiments of the invention may be fabricated using existing processes and methods from industries such as pressure vessel making, ship and submarine building, manufacturing of heavy construction equipment, and the aerospace industry. The curvature of the blast shield 100 may be formed by any suitable technique, which may include roll forming, pinch rolling, line heating and bending, and/or hydroforming. The attachment flanges 132, 134 may be formed by press bending or roll forming, or added to the blast shield 100 by welding. Notably, fabrication equipment and techniques may be employed to construct at least the main section 110 from a monolithic stock into a single-piece, unitary, monolithic member not having seams or joints that might present weak regions or stress concentration regions in the shield 100.

Fabrication of the blast shield 100 from fiber-reinforced composites is well enabled by existing processes and methods from industries such as aircraft and boat manufacture. A mold having the intended curvature of the blast shield 100 may be created and fiber-reinforced composites formed on this mold. Methods for forming of the composite include use of fibers pre-impregnated with resin and fibers infused with resin in the mold using some variant of resin transfer molding.

Embodiments of the present invention can provide superior blast shielding for use in armored vehicles. A specific blast shield curvature, based on variational principles, can be used to produce the shape of the hull. This design, as opposed to V-hull designs and other designs based on V-hulls, can both deflect blasts located beneath armored vehicles and reduce the overall rolling moment induced by blast loading from mines or improvised explosive device (IED) blasts.

Regardless of the lateral offset of an explosive threat, the aerodynamic and structural traits of the inventive curved blast shield can provide less impact in the vertical direction than faceted/segmented hull designs, curved hulls, or flat hulls. A hull surface of the present invention can minimize the horizontal surfaces which would cause such violent vertical movements of the vehicle. In addition to the lack of horizontal surfaces, the smooth curve defined by the hull according to embodiments of the present invention allows the blast wave to pass out of the way of the vehicle with little resistance and prevents most secondary reflections off of the ground.

The continuous curvature structure of the blast shield 100 can have inherent advantages over discontinuous and faceted structures in resisting external surface loads. These advantages can be a result of membrane action. A primary reason is that continuous curvature structures do not suffer from stress concentrations that occur at the vertices of discontinuous and faceted structures. A continuous curvature blast shield or shell allows the steady flow of in-plane loads out to the boundaries of the shell; this is in contrast to a discontinuous structure that requires a load vector to change directions. Further, structural blast shields or shells of catenary and hyperboloid geometry loaded on the convex side have reduced bending stress as compared to discontinuous and faceted structures. Load transfer is instead carried out by in-plane compressive stresses; thus the membrane action. Many of the materials that may be desired for the application at hand, including metals such as steel and aluminum, have higher compressive stress failure values than tensile stress values. In this case, relevant tensile stress is a component of bending stress. Also, the reduction of bending stress, and thus out-of-plane deformation, results in a structure that is more geometrically stable and resistant to buckling and catastrophic collapse.

According to some embodiments, the thickness T (FIG. 2) of the main section 110 is in the range of from about 0.25 inches to 4 inches and, according to some embodiments, from about 2 inches to 3 inches.

According to some embodiments, the length D (FIG. 4) of the main section 110 is in the range of from about 2 feet to 10 feet and, according to some embodiments, from about 6 feet to 8 feet.

According to some embodiments, the full width M (FIG. 2) of the main section 110 is in the range of from about 4 feet to 8 feet and, according to some embodiments, from about 5 feet to 6 feet.

According to some embodiments, the linear distance Q (FIG. 2) between the end points E1, E2 of the profile curve P is in the range of from about 3.75 feet to 8 feet and, according to some embodiments, from about 4.75 feet to 6 feet.

According to some embodiments, the arc length R (FIG. 2) between the end points E1, E2 of the profile curve P is in the range of from about 4.25 feet to 15 feet and, according to some embodiments, from about 5.25 feet to 11.25 feet According to some embodiments, the maximum height F (FIG. 2) of the profile curve P from the highest one of the end points E1, E2 to the lowest point on the profile P is in the range of from about 0.75 feet to 6 feet and, according to some embodiments, from about 1 foot to 4.5 feet.

According to some embodiments, the ratio of the height F to the distance Q is the range of from about 0.2 to 0.75 and, according to some embodiments, from about 0.21 to 0.75.

The blast shield 100 may be used as follows in accordance with embodiments of the present invention. The blast shield 100 is mounted on or integrated into the vehicle 10 as discussed above to form the shielded vehicle 15. In service, the impact surface 112 generally faces the ground G and the ground plane GP-GP. The shielded vehicle 15 may be deployed in an area or environment that is hostile or that otherwise presents a risk of a blast or explosion from or at ground level adjacent the vehicle 15. In the event of such a blast or explosion, blast force and debris from the explosion is received and deflected or shed by the impact surface 112.

According to some embodiments, the minimum heightwise distance J (FIG. 8) between the impact section 110 and the ground G in service (when on level ground) is in the range of from about 6 inches to 36 inches and, according to some embodiments, in the range of from about 16 inches to 20 inches.

Figure 10:
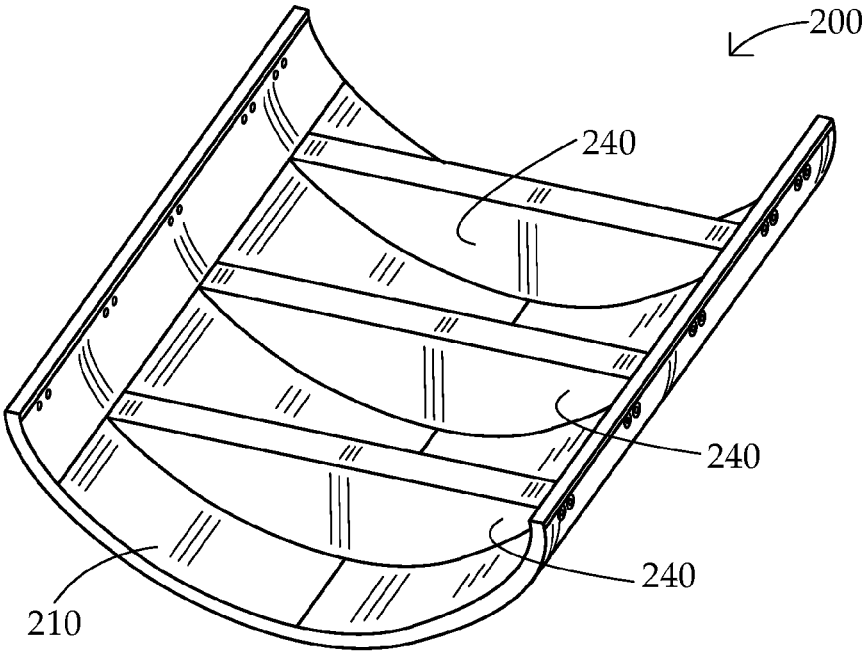
FIG. 10 is a perspective view of a blast shield according to further embodiments of the present invention.

With reference to FIG. 10, a blast shield 200 according to further embodiments of the invention is shown therein. The blast shield 200 corresponds to the shield 100 except that the shield 200 is further provided with integral, laterally extending reinforcing ribs 240 to fortify the main section 210. Inclusion and construction of the reinforcing ribs 240 may depend on the desired level of blast shielding desired and vehicle packaging constraints.

The foregoing is illustrative of the present invention and is not to be construed as limiting thereof. Although a few exemplary embodiments of this invention has been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

What is claimed is:

1. An underbody blast shield for deflecting a blast incident on a ground vehicle, the blast shield comprising:

an impact section having an exterior impact surface to face a source of the blast, wherein the exterior impact surface defines a cross-sectional profile defining a smooth continuous curve;

wherein the profile defines a catenary generally described by the equation:

$$y = \frac{a}{2}\left(e^{\frac{x}{a}} + e^{-\frac{x}{a}}\right)$$

wherein:

x is the coordinate on the profile along a vehicle lateral axis;

y is the coordinate on the profile along a vehicle vertical axis;

a is the curvature coefficient that defines the curve aspect ratio; and e is the base of the natural logarithm function, approximated by 2.7182818 . . . ; and wherein the profile defines a catenary over the entirety of the profile, and the profile is defined by at least a majority of the width of the impact surface of the blast shield.

2. The blast shield of claim 1 wherein the profile defines a catenary having a curvature coefficient in the range of from 3 to 30.

3. The blast shield of claim 1 wherein the impact section is monolithic.

4. The blast shield of claim 1 wherein the impact section is formed of metal.

5. The blast shield of claim 1 wherein the impact section is formed of fiber-reinforced composite.

6. The blast shield of claim 1 including at least one vehicle attachment structure integral with the impact section and configured to secure the blast shield to the ground vehicle.

7. The blast shield of claim 1 including a reinforcing rib extending across the impact section on an interior side thereof opposite the impact surface.

8. A shielded ground vehicle comprising:

a ground vehicle; and an underbody blast shield for deflecting a blast incident on the ground vehicle, the blast shield being integrated with the ground vehicle and including an impact section having an exterior impact surface to face a source of the blast, wherein the exterior impact surface defines a cross-sectional profile defining a smooth continuous curve;

wherein the profile defines a catenary generally described by the equation:

$$y = \frac{a}{2}\left(e^{\frac{x}{a}} + e^{-\frac{x}{a}}\right)$$

wherein:

x is the coordinate on the profile along a vehicle lateral axis;

y is the coordinate on the profile along a vehicle vertical axis;

a is the curvature coefficient that defines the curve aspect ratio; and e is the base of the natural logarithm function, approximated by 2.7182818 . . . ; and wherein the profile defines a catenary over the entirety of the profile, and the profile is defined by at least a majority of the width of the impact surface of the blast shield.

9. The shielded ground vehicle of claim 8 wherein the profile defines a catenary having a curvature coefficient in the range of from 3 to 30.

10. The shielded ground vehicle of claim 8 wherein the impact section is monolithic.

11. The shielded ground vehicle of claim 8 wherein the impact section is formed of metal.

12. The shielded ground vehicle of claim 8 wherein the impact section is formed of fiber-reinforced composite.

13. The shielded ground vehicle of claim 8 wherein the blast shield includes at least one vehicle attachment structure integral with the impact section and securing the blast shield to the ground vehicle.

14. The shielded ground vehicle of claim 8 wherein the blast shield includes a reinforcing rib extending across the impact section on an interior side thereof opposite the impact surface.

15. A method for operating a shielded ground vehicle, the method comprising:

providing a shielded ground vehicle including:

a ground vehicle; and an underbody blast shield for deflecting a blast incident on the ground vehicle, the blast shield being integrated with the ground vehicle and including an impact section having an exterior impact surface to face a source of the blast, wherein the exterior impact surface defines a cross-sectional profile defining a smooth continuous curve;

wherein the profile defines a catenary generally described by the equation:

$$y = \frac{a}{2}\left(e^{\frac{x}{a}} + e^{-\frac{x}{a}}\right)$$

wherein:

x is the coordinate on the profile along a vehicle lateral axis;

y is the coordinate on the profile along a vehicle vertical axis;

a is the curvature coefficient that defines the curve aspect ratio; and e is the base of the natural logarithm function, approximated by 2.7182818 . . . ; and wherein the profile defines a catenary over the entirety of the profile and the profile is defined by at least a majority of the width of the impact surface of the blast shield; and receiving a blast on the exterior impact surface.

* * * * *

UNITED STATES PATENT AND TRADEMARK OFFICE

CERTIFICATE OF CORRECTION

PATENT NO. : 8,640,594 B2
APPLICATION NO. : 13/361546
DATED : February 4, 2014
INVENTOR(S) : Treadway et al.

It is certified that error appears in the above-identified patent and that said Letters Patent is hereby corrected as shown below:

In the Specification:

Column 6, Line 3: Please correct "a is the curvature"
to read -- *a* is the curvature --

In the Claims:

Column 8, Claim 1, Line 64: Please correct "a is the curvature"
to read -- *a* is the curvature --

Column 9, Claim 8, Line 40: Please correct "a is the curvature"
to read -- *a* is the curvature --

Column 10, Claim 15, Line 40: Please correct "a is the curvature"
to read -- *a* is the curvature --

Signed and Sealed this
Seventh Day of October, 2014

Michelle K. Lee

Michelle K. Lee
*Deputy Director of the United States Patent and Trademark Office*